US011501699B1

(12) United States Patent
Choi et al.

(10) Patent No.: US 11,501,699 B1
(45) Date of Patent: Nov. 15, 2022

(54) DISPLAY DEVICE

(71) Applicant: Samsung Display Co., Ltd., Yongin-si (KR)

(72) Inventors: Yang-Hwa Choi, Hwaseong-si (KR); Junghwan Hwang, Seongnam-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/683,763

(22) Filed: Mar. 1, 2022

(30) Foreign Application Priority Data

May 3, 2021 (KR) ..... 10-2021-0057238

(51) Int. Cl.
*G09G 3/32* (2016.01)

(52) U.S. Cl.
CPC ..... *G09G 3/32* (2013.01); *G09G 2310/061* (2013.01); *G09G 2320/0247* (2013.01); *G09G 2340/0435* (2013.01)

(58) Field of Classification Search
CPC ..... G09G 3/32; G09G 2310/061; G09G 2320/0247; G09G 2340/0435
See application file for complete search history.

(56) References Cited

U.S. PATENT DOCUMENTS 6,870,523 B1 3/2005 Ben-David et al.
10,891,903 B2 1/2021 Takasugi
10,937,370 B2 3/2021 Son
2016/0124491 A1* 5/2016 An ..... G06F 1/3265 713/323
2016/0125798 A1* 5/2016 Park ..... G09G 3/3208 345/204
2017/0169765 A1* 6/2017 Lee ..... G09G 3/3258
2018/0151124 A1* 5/2018 An ..... G09G 3/3266
2019/0378459 A1* 12/2019 Kim ..... G09G 3/3291
2022/0122512 A1* 4/2022 Lee ..... G09G 3/3291
2022/0157263 A1* 5/2022 Moon ..... G09G 3/3291
2022/0208080 A1* 6/2022 Kim ..... G09G 3/32

FOREIGN PATENT DOCUMENTS

KR 1020180127896 A 11/2018
KR 1020200057204 A 5/2020
KR 1020200080787 A 7/2020

* cited by examiner

*Primary Examiner* — Andrew Sasinowski
(74) *Attorney, Agent, or Firm* — Cantor Colburn LLP

(57) ABSTRACT

A display device includes a display panel including a pixel and a panel driver which drives the display panel at a first panel frequency in a first driving mode and drives the display panel at a second panel frequency in a second driving mode. The pixel includes a light emitting element and first, second, third, and fourth transistors. The first transistor is connected between a power line and the light emitting element. The second transistor is connected between a data line and the first transistor and receives a first scan signal. The third transistor is connected between the first transistor and an initialization voltage line and receives a second scan signal. The fourth transistor is connected between the first transistor and a reset voltage line and receives a third scan signal. The third scan signal is inactivated in the first driving mode and is activated in the second driving mode.

20 Claims, 7 Drawing Sheets

DISPLAY DEVICE

This application claims priority to Korean Patent Application No. 10-2021-0057238, filed on May 3, 2021, and all the benefits accruing therefrom under 35 U.S.C. § 119, the content of which in its entirety is herein incorporated by reference.

BACKGROUND

1. Field

The disclosure relates to a display device. More particularly, the disclosure relates to a display device having improved display quality.

2. Description of the Related Art

Among display devices, a light emitting type display device may display an image using a light emitting diode that emits a light by a recombination of electrons and holes. The light emitting type display device has the desired characteristics such as fast response speed and low power consumption.

The light emitting type display device typically includes pixels connected to data lines and scan lines. Each pixel may include a light emitting diode and a circuit part to control an amount of current flowing through the light emitting diode. The circuit part controls the amount of current flowing to a second driving voltage from a first driving voltage via the light emitting diode in response to a data signal. In this case, a light with a predetermined luminance is generated in response to the amount of current flowing through the light emitting diode.

SUMMARY

The disclosure provides a display device capable of improving a phenomenon in which a display quality of the display device is deteriorated as a driving frequency is changed.

An embodiment of the invention provide a display device including a display panel including a pixel and a panel driver which drives the display panel at a first panel frequency in a first driving mode and drives the display panel at a second panel frequency lower than the first panel frequency in a second driving mode.

In such an embodiment, the pixel includes a light emitting element including a cathode and an anode, a first transistor connected between a first driving voltage line and the anode of the light emitting element, a second transistor connected between a data line and a first electrode of the first transistor, where the second transistor receives a first scan signal, a third transistor connected between a second electrode of the first transistor and an initialization voltage line, where the third transistor receives a second scan signal, and a fourth transistor connected between the second electrode of the first transistor and a reset voltage line, where the fourth transistor receives a third scan signal.

In such an embodiment, the third scan signal is inactivated in the first driving mode and is activated in the second driving mode.

An embodiment of the invention provide a display device including a display panel including a pixel and a panel driver which drives the display panel at a first panel frequency in a first driving mode and drives the display panel at a second panel frequency lower than the first panel frequency in a second driving mode.

In such an embodiment, the panel driver includes a first scan driver which outputs first and second scan signals to the pixel and a second scan driver which outputs a third scan signal to the pixel.

In such an embodiment, the display panel displays an image in a unit of a first mode frame in the first driving mode and displays the image in a unit of a second mode frame in the second driving mode, the first mode frame includes a first enable period and a first blank period, and the second mode frame includes a second enable period and a second blank period.

In such an embodiment, the first scan driver is activated in the first and second enable periods, and the second scan driver is activated in the second blank period.

According to embodiments of the invention, the display device drives the display panel at the first panel frequency in the first driving mode and drives the display panel at the second panel frequency in the second driving mode. In such embodiments, the anode of the light emitting element is periodically reset at a first frequency even after the second driving mode starts as in the first driving mode. Accordingly, a difference in luminance does not occur in a low grayscale even though the first driving mode is switched to the second driving mode, such that a flicker may be effectively prevented from being recognized. Thus, a display quality of the display device is improved.

BRIEF DESCRIPTION OF THE DRAWINGS

The above and other features of the disclosure will become readily apparent by reference to the following detailed description when considered in conjunction with the accompanying drawings, in which.

DETAILED DESCRIPTION

Figure 1:
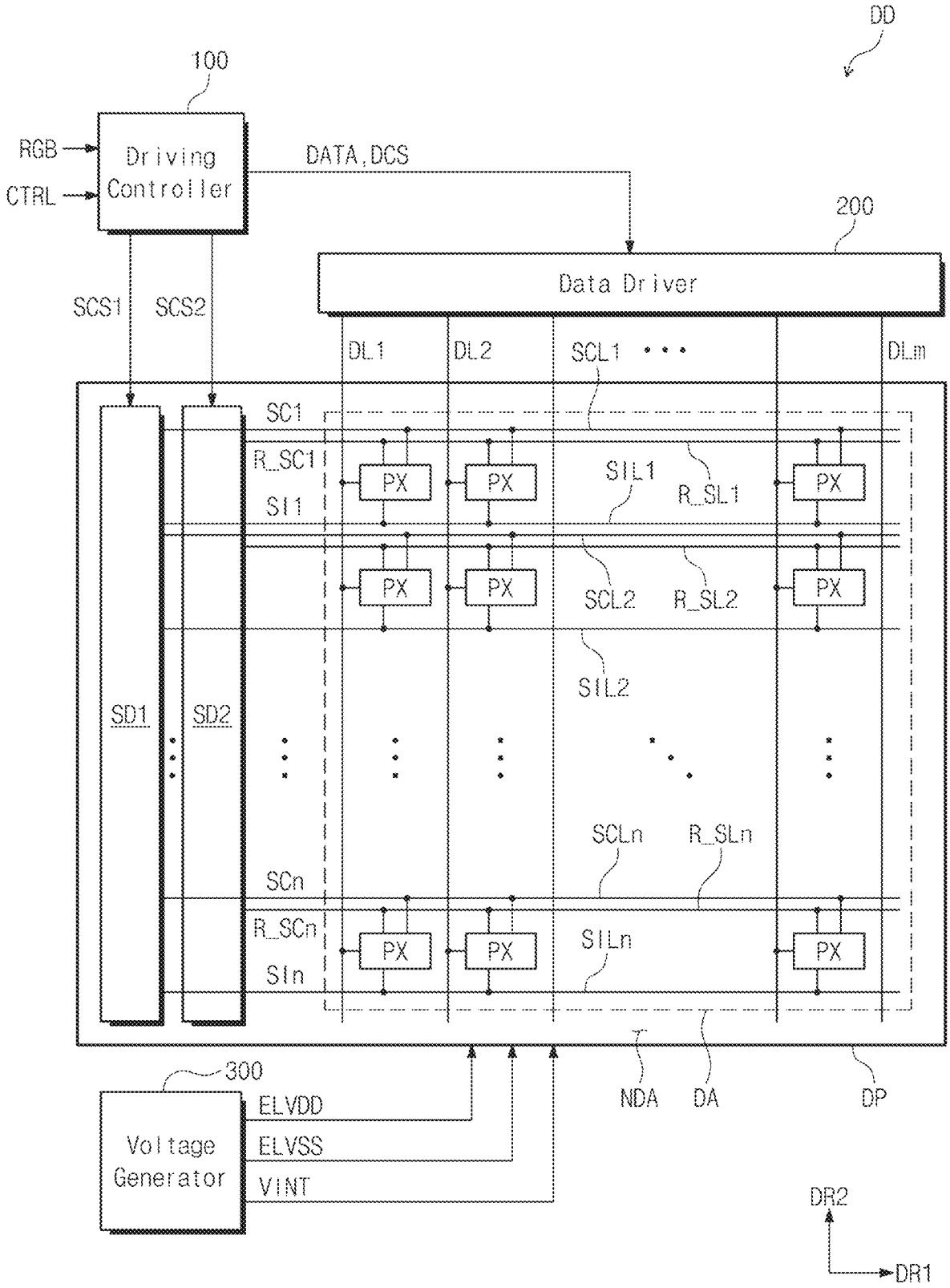
FIG. 1 is a block diagram showing a display device according to an embodiment of the disclosure.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

In the disclosure, it will be understood that when an element such as a layer, film, region, or substrate is referred to as being "on" another element, it may be "directly on" the other element or intervening elements may also be present. In contrast, when an element is referred to as being "directly on" another element, there are no intervening elements present. It will be understood that when an element such as a layer, film, region, or substrate is referred to as being "under" another element, it may be "directly under" the other element or intervening elements may also be present. In addition, the term "on" in the disclosure may mean that a portion of an element is disposed at a lower portion as well as an upper portion of another element.

Meanwhile, in the disclosure, when an element is referred to as being "directly connected" to another element, there are no intervening elements present between a layer, film region, or substrate and another layer, film, region, or substrate. For example, the term "directly connected" may mean that two layers or two members are disposed without employing additional adhesive therebetween.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10% or 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Hereinafter, embodiments of the disclosure will be described in detail with reference to the accompanying drawings.

FIG. 1 is a block diagram showing a display device DD according to an embodiment of the disclosure.

Referring to FIG. 1, an embodiment of the display device DD may be a device activated in response to electrical signals to display images. The display device DD may be applied to or included in an electronic device, such as a smart watch, a tablet computer, a notebook computer, a computer, a smart television, etc.

The display device DD may include a display panel DP, a panel driver, and a driving controller 100. In an embodiment, the panel driver may include a data driver 200, a first scan driver SD1, a second scan driver SD2, and a voltage generator 300.

The driving controller 100 may receive image signals RGB and a control signal CTRL. The driving controller 100 may convert a data format of the image signals RGB to a data format appropriate to an interface between the data driver 200 and the driving controller 100 to generate an image data signal DATA. The driving controller 100 may output a first scan control signal SCS1, a second scan control signal SCS2, and a data control signal DCS.

The data driver 200 may receive the data control signal DCS and the image data signal DATA from the driving controller 100. The data driver 200 may convert the image data signal DATA to data signals and may output the data signals to a plurality of data lines DL1 to DLm described later. The data signals may be analog voltages corresponding to grayscale values of the image data signal DATA.

The first scan driver SD1 may receive the first scan control signal SCS1 from the driving controller 100, and the second scan driver SD2 may receive the second scan control signal SCS2 from the driving controller 100. The first scan driver SD1 may output compensation scan signals SC1 to SCn and initialization scan signals SI1 to SIn in response to the first scan control signal SCS1. The second scan driver SD2 may output reset scan signals R_SC1 to R_SCn in response to the second scan control signal SCS2.

The voltage generator 300 may generate voltages required for an operation of the display panel DP. In an embodiment, the voltage generator 300 may generate a first driving voltage ELVDD, a second driving voltage ELVSS, and an initialization voltage VINT.

The display panel DP may include compensation scan lines SCL1 to SCLn, initialization scan lines SIL1 to SILn, reset scan lines R_SL1 to R_SLn, the data lines DL1 to DLm, and the pixels PX. The display panel DP may include a display area DA, through which an image is displayed, and a non-display area NDA defined adjacent to the display area DA. The compensation scan lines SCL1 to SCLn, the initialization scan lines SIL1 to SILn, the reset scan lines R_SL1 to R_SLn, the data lines DL1 to DLm, and the pixels PX may be arranged in the display area DA. The compensation scan lines SCL1 to SCLn, the initialization scan lines SIL1 to SILn, and the reset scan lines R_SL1 to R_SLn may extend in a first direction DR1. The compensation scan lines SCL1 to SCLn, the initialization scan lines SIL1 to SILn, and the reset scan lines R_SL1 to R_SLn may be arranged in a second direction DR2 to be spaced apart from each other. The second direction DR2 may cross the first direction DR1. The data lines DL1 to DLm may extend in the second direction DR2 and may arranged in the first direction DR1 to be spaced apart from each other.

The pixels PX may be electrically connected to the compensation scan lines SCL1 to SCLn, the initialization scan lines SIL1 to SILn, the reset scan lines R_SL1 to R_SLn, and the data lines DL1 to DLm. Each of the pixels PX may be electrically connected to three scan lines. In one embodiment, for example, as shown in FIG. 1, the pixels arranged in a first row may be connected to a first compensation scan line SCL1, a first initialization scan line SILL and a first reset scan line R_SL1. In such an embodiment, the pixels arranged in a second row may be connected to a second compensation scan line SCL2, a second initialization scan line SIL2, and a second reset scan line R_SL2.

The first and second scan drivers SD1 and SD2 may be disposed in the non-display area NDA of the display panel DP. The first scan driver SD1 may output the compensation scan signals SC1 to SCn and the initialization scan signals SD to SIn to the compensation scan lines SCL1 to SCLn and the initialization scan lines SIL1 to SILn in response to the first scan control signal SCS1. The second scan driver SD2 may output the reset scan signals R_SC1 to R_SCn to the reset scan lines R_SL1 to R_SLn in response to the second scan control signal SCS2.

Each of the pixels PX may include a light emitting element ED (refer to FIG. 2) and a pixel circuit part PXC (refer to FIG. 2) that controls an emission of the light emitting element ED. The pixel circuit part PXC may include a plurality of transistors and a capacitor. The first and second scan drivers SD1 and SD2 may include transistors formed through a same processes as those of the pixel circuit part PXC.

Each of the pixels PX may receive the first driving voltage ELVDD, the second driving voltage ELVSS, and the initialization voltage VINT from the voltage generator 300.

Figure 2:
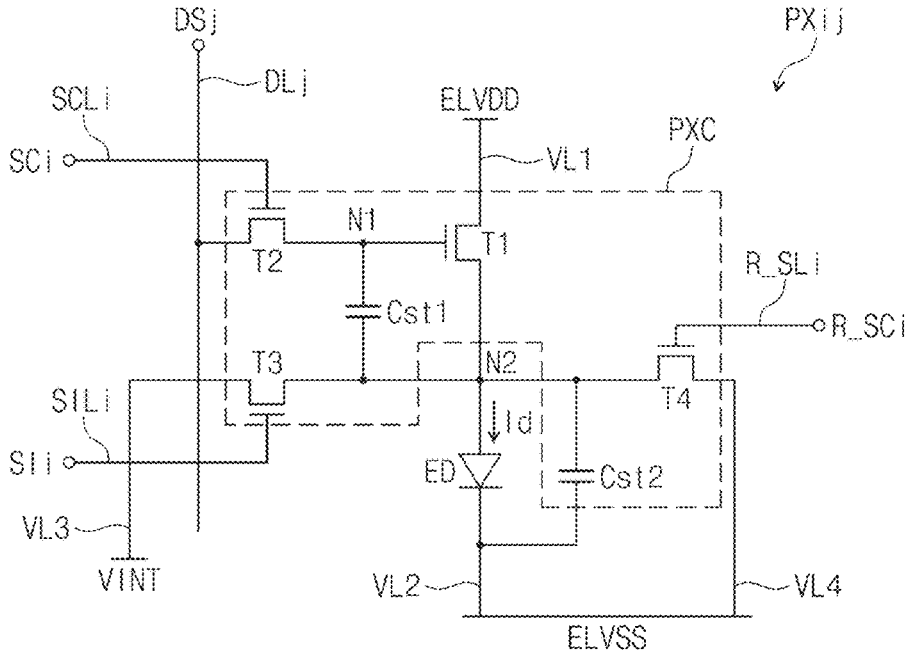
FIGS. 2 and 3 are circuit diagrams showing a pixel according to an embodiment of the disclosure.
Figure 3:
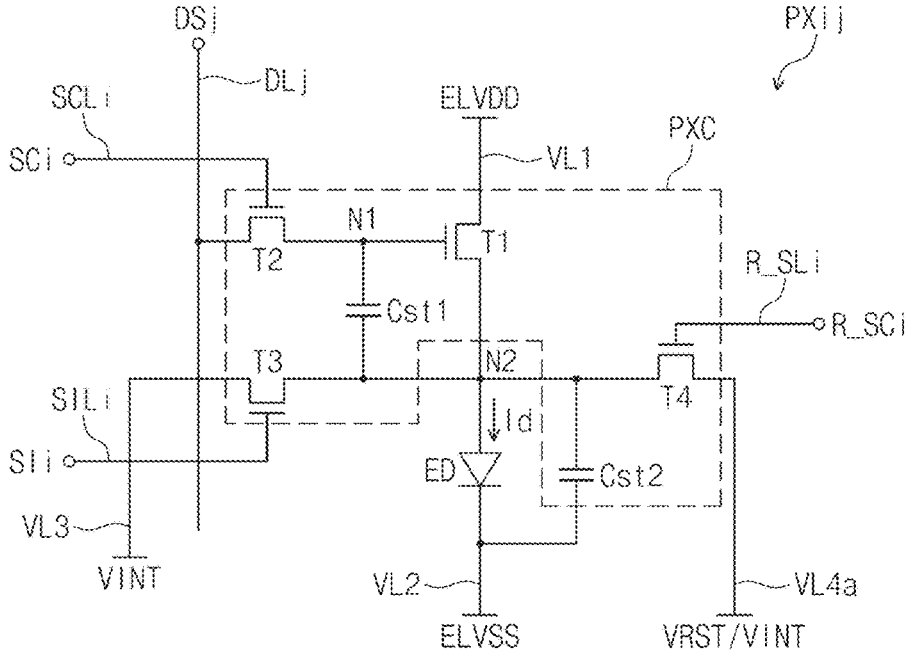

FIGS. 2 and 3 are circuit diagrams showing a pixel PXij according to an embodiment of the disclosure.

FIGS. 2 and 3 show an equivalent circuit diagram of an embodiment of one pixel PXij among the pixels PX shown in FIG. 1. Since the pixels PX have substantially the same circuit configuration as each other, the configuration of the one pixel PXij (hereinafter, the pixel PXij) will hereinafter be described in detail, and any repetitive detailed descriptions about the other pixels PX will be omitted.

Referring to FIG. 2, the pixel PXij may be connected to a j-th data line DLj (hereinafter, referred to as a data line) among the data lines DL1 to DLm, an i-th compensation scan line SCLi (hereinafter, referred to as a compensation scan line), an i-th initialization scan line SILi (hereinafter, referred to as an initialization scan line), and an i-th reset scan line R_SLi (hereinafter, referred to as a reset scan line).

The pixel PXij may include the light emitting element ED and the pixel circuit part PXC. The pixel circuit part PXC may include first, second, third, and fourth transistors T1, T2, T3, and T4 and first and second capacitors Cst1 and Cst2. Each of the first to fourth transistors T1 to T4 may be a transistor including a low-temperature polycrystalline silicon ("LTPS") semiconductor layer or a transistor including an oxide semiconductor layer. The first to fourth transistors T1 to T4 may be implemented by substantially a same type transistor as each other. In one embodiment, for example, each of the first to fourth transistors T1 to T4 may be an N-type transistor. However, the configuration of the pixel circuit part PXC according to the disclosure should not be limited to the embodiment shown in FIG. 2. The pixel circuit part PXC shown in FIG. 2 is merely one embodiment, and the configuration of the pixel circuit part PXC may be changed in various ways. In one alternative embodiment, for example, each of the first to fourth transistors T1 to T4 may be a P-type transistor. Alternatively, some of the first to fourth transistors T1 to T4 may be the N-type transistor, and the other of the first to fourth transistors T1 to T4 may be the P-type transistor.

The first transistor T1 may be connected between a first driving voltage line VL1 and the light emitting element ED. The first transistor T1 may include a first electrode connected to the first driving voltage line VL1, a second electrode connected to an anode of the light emitting element ED, and a third electrode connected to a first node N1. Herein, the expression "a transistor is connected to a signal line" means that one electrode of a first electrode, a second electrode and a third electrode of the transistor is provided integrally with the signal line or is connected to the signal line via a connection electrode. In addition, the expression "a transistor is electrically connected to another transistor" means that one electrode of a first electrode, a second electrode and a third electrode of the transistor is provided integrally with one electrode of a first electrode, a second electrode, and a third electrode of another transistor or is connected to one electrode of the first electrode, the second electrode, and the third electrode of another transistor via a connection electrode.

The first driving voltage line VL1 may transmit the first driving voltage ELVDD to the pixel PXij. The first transistor T1 may receive the data signal DSj transmitted by the data line DLj and may supply a driving current Id to the light emitting element ED based on a switching operation of the second transistor T2.

The second transistor T2 may be connected between the data line DLj and the first transistor T1. The second transistor T2 may include a first electrode connected to the data line DLj, a second electrode connected to the third electrode of the first transistor T1, and a third electrode which receives a compensation scan signal SCi. The third electrode of the second transistor T2 may be electrically connected to the compensation scan line SCLi. Accordingly, the second transistor T2 may receive the compensation scan signal SCi from the compensation scan line SCLi. The second transistor T2 may be turned on in response to the compensation scan signal SCi and may transmit the data signal DSj from the data line DLj to the third electrode of the first transistor T1. In such an embodiment, the first node N1 may be a node at which the second electrode of the second transistor T2 is electrically connected to the third electrode of the first transistor T1.

The third transistor T3 may be connected between the second node N2 and an initialization voltage line VL3. The third transistor T3 may include a first electrode connected to a second node N2, a second electrode connected to the initialization voltage line VL3, and a third electrode which receives an initialization scan signal SIi. The third electrode of the third transistor T3 may be electrically connected to the initialization scan line SILi. Accordingly, the third transistor T3 may receive the initialization scan signal SIi from the initialization scan line SILi. The third transistor T3 may be turned on in response to the initialization scan signal SIi and may initialize the anode of the light emitting element ED to the initialization voltage VINT from the initialization voltage line VL3. In such an embodiment, the second node N2 may be a node at which the second electrode of the first transistor T1, the first electrode of the third transistor T3, and the anode of the light emitting element ED are electrically connected.

The fourth transistor T4 may be connected between the second node N2 and a reset voltage line VL4. The fourth transistor T4 may include a first electrode connected to the second node N2, a second electrode connected to the reset voltage line VL4, and a third electrode which receives a reset scan signal R_SCi. The third electrode of the fourth transistor T4 may be electrically connected to the reset scan line R_SLi. Accordingly, the fourth transistor T4 may receive the reset scan signal R_SCi from the reset scan line R_SLi. The fourth transistor T4 may be turned on in response to the reset scan signal R_SCi and may reset the anode of the light emitting element ED to the second driving voltage ELVSS provided from the reset voltage line VL4. The reset voltage line VL4 may be electrically connected to a second driving voltage line VL2 or may be provided integrally with the second driving voltage line VL2. In an embodiment where the fourth transistor T4 receives the second driving voltage ELVSS, the reset voltage line VL4 may be omitted, and the second electrode of the fourth transistor T4 may be directly connected to the second driving voltage line VL2. Accordingly, the second node N2 may be reset to the second driving voltage ELVSS in the turn-on period of the fourth transistor T4. In such an embodiment, the second driving voltage ELVSS may have a voltage level lower than that of the first driving voltage ELVDD.

The light emitting element ED may be connected between the second node N2 and the second driving voltage line VL2. The anode of the light emitting element ED may be connected to the second node N2, and a cathode of the light emitting element ED may be connected to the second driving voltage line VL2.

The first capacitor Cst1 may be connected between the first node N1 and the second node N2. A first electrode of the first capacitor Cst1 may be electrically connected to the first node N1, and a second electrode of the first capacitor Cst1 may be electrically connected to the second node N2. The second capacitor Cst2 may be connected between the second node N2 and the second driving voltage line VL2. A first electrode of the second capacitor Cst2 may be electrically connected to the second node N2, and a second electrode of the second capacitor Cst2 may be electrically connected to the second driving voltage line VL2.

Each of the compensation scan signal SCi and the initialization scan signal SIi may have a high level in some periods and a low level in some periods. In an embodiment, where each of the second and third transistors T2 and T3 is the N-type transistor, the high level period of each of the compensation scan signal SCi and the initialization scan signal SIi may be defined as an active period in which the second and third transistors T2 and T3 are turned on. The low level period of each of the compensation scan signal SCi and the initialization scan signal SIi may be defined as an inactive period in which the second and third transistors T2 and T3 are turned off. In an alternative embodiment, where each of the second and third transistors T2 and T3 is the P-type transistor, the low level period of each of the compensation scan signal SCi and the initialization scan signal SIi may be defined as the active period, and the high level period of each of the compensation scan signal SCi and the initialization scan signal SIi may be defined as the inactive period.

According to an embodiment, as shown in FIG. 2, the third transistor T3 may be turned on in the active period of the initialization scan signal SIi. When the third transistor T3 is turned on, the initialization voltage VINT may be applied to the second node N2 via the third transistor T3. Accordingly, the second node N2 may be initialized to the initialization voltage VINT, and the second electrode of the first transistor T1, the anode of the light emitting element ED, the second electrode of the first capacitor Cst1, and the first electrode of the second capacitor Cst2, which are connected to the second node N2, may be initialized to the initialization voltage VINT.

In such an embodiment, the second transistor T2 may be turned on in the active period of the compensation scan signal SCi. When the second transistor T2 is turned on, the data signal DSj may be applied to the first node N1 via the second transistor T2. Accordingly, the data signal DSj may be applied to the third electrode of the first transistor T1 and the first electrode of the first capacitor Cst1, which are electrically connected to the first node N1. When the data signal DSj is applied to the third electrode of the first transistor T1, the first transistor T1 may be turned on.

In one embodiment, for example, the active period of the initialization scan signal SIi may overlap the active period of the compensation scan signal SCi. In such an embodiment, the data signal DSj and the initialization voltage VINT may be respectively applied to both ends of the first capacitor Cst1, and the first capacitor Cst1 may be charged with electric charges corresponding to a voltage difference (DSj-VINT) between the both ends of the first capacitor Cst1.

In such an embodiment, the second driving voltage ELVSS may be applied to the cathode of the light emitting element ED. Accordingly, the initialization voltage VINT having the voltage level lower than the voltage level of the second driving voltage ELVSS is applied to the second node N2, and thus, no current flows through the light emitting element ED.

During the inactive period of the compensation scan signal SCi, the second transistor T2 may be turned off, and during the inactive period of the initialization scan signal SIi, the third transistor T3 may be turned off. In one embodiment, for example, the inactive period of the compensation scan signal SCi may overlap the inactive period of the initialization scan signal SIi.

Although the second transistor T2 is turned off for the inactive period of the compensation scan signal SCi, the first transistor T1 may be maintained in the turn-on state by the electric charges charged in the first capacitor Cst1, such that the driving current Id may flow through the first transistor T1, and electric charges may be charged in the second capacitor Cst2 by the driving current Id. When the electric charges are charged in the second capacitor Cst2 and the voltage level of the anode of the light emitting element ED becomes higher than the voltage level of the cathode of the light emitting element ED, the driving current Id may flow to the light emitting element ED, and the light emitting element ED may emit a light. In this case, when the electric charges are charged in the second capacitor Cst2 by the driving current Id and the voltage level of the second node N2 increases, the voltage level of the first node N1 may increase due to a coupling effect of the first capacitor Cst1, and thus, the driving current Id flowing through the first transistor T1 may be maintained. In such an embodiment, a level of the driving current Id may be in proportion to the voltage level of the data signal DSj applied to the third electrode of the first transistor T1.

The reset scan signal R_SCi may have a high level in some periods and a low level in some periods. In an embodiment where the fourth transistor T4 is the N-type transistor, the high level period of the reset scan signal R_SCi may be defined as an active period in which the fourth transistor T4 is turned on, and the low level period of the reset scan signal R_SCi may be defined as an inactive period in which the fourth transistor T4 is turned off. In an alternative embodiment, where the fourth transistor T4 is the P-type transistor, the low level period of the reset scan signal R_SCi may be defined as the active period, and the high level period of the reset scan signal R_SCi may be defined as the inactive period.

The fourth transistor T4 may be turned on for the active period of the reset scan signal R_SCi. When the fourth transistor T4 is turned on, the second driving voltage ELVSS may be transmitted to the second node N2 via the fourth transistor T4. Accordingly, the second node N2 may be reset to the second driving voltage ELVSS. However, the fourth transistor T4 may be turned off for the inactive period of the reset scan signal R_SCi. When the fourth transistor T4 is in the turn-off state, the second node N2 may not be reset to the second driving voltage ELVSS.

In such an embodiment, the active period of the reset scan signal R_SCi may not overlap the active period of the compensation scan signal SCi and the initialization scan signal SIi.

Referring to FIG. 3, the fourth transistor T4 may be connected between the second node N2 and a reset voltage line VL4*a*. The fourth transistor T4 may include a first electrode connected to the second node N2, a second electrode connected to the reset voltage line VL4*a*, and a third electrode which receives the reset scan signal R_SCi. A reset voltage VRST or the initialization voltage VINT may be applied to the reset voltage line VL4*a*. The fourth transistor T4 may be turned on in response to the reset scan signal R_SCi and may reset the anode of the light emitting element ED to the reset voltage VRST or the initialization voltage VINT provided from the reset voltage line VL4*a*.

In an embodiment where the reset voltage line VL4*a* receives the reset voltage VRST, the reset voltage line VL4*a* may be electrically separated from the second driving voltage line VL2. The reset voltage VRST may have a voltage level that is equal to or smaller than that of the second driving voltage ELVSS.

In an embodiment where the reset voltage line VL4*a* receives the initialization voltage VINT, the reset voltage line VL4*a* may be electrically separated from the second driving voltage line VL2 and may be electrically connected to the initialization voltage line VL3. In such an embodiment where the reset voltage line VL4*a* receives the initialization voltage VINT, the reset voltage line VL4*a* may be omitted, and the second electrode of the fourth transistor T4 may be directly connected to the initialization voltage line VL3.

Figure 4:
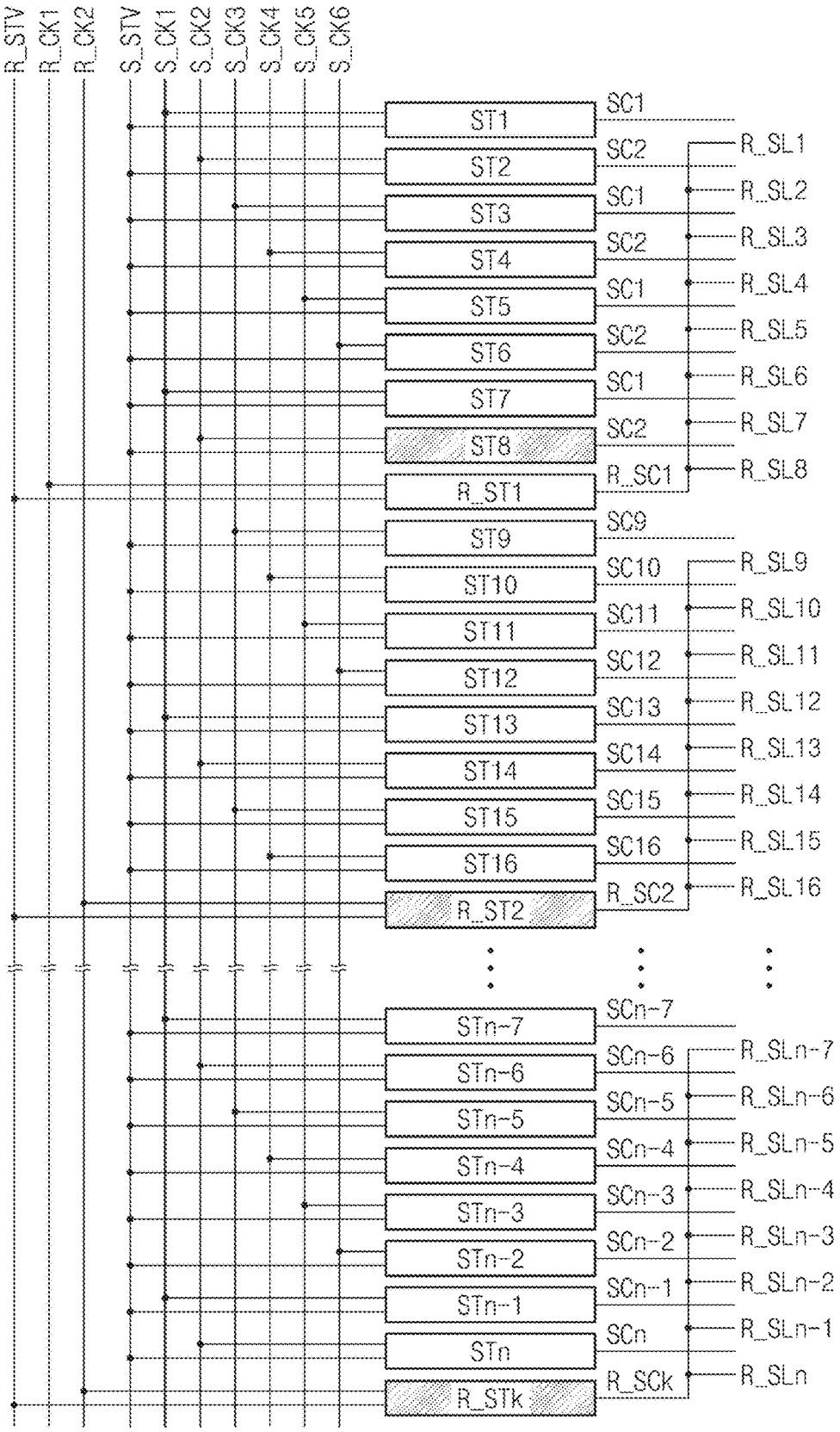
FIG. 4 is a block diagram showing first and second scan drivers shown in FIG. 1.
Figure 5:
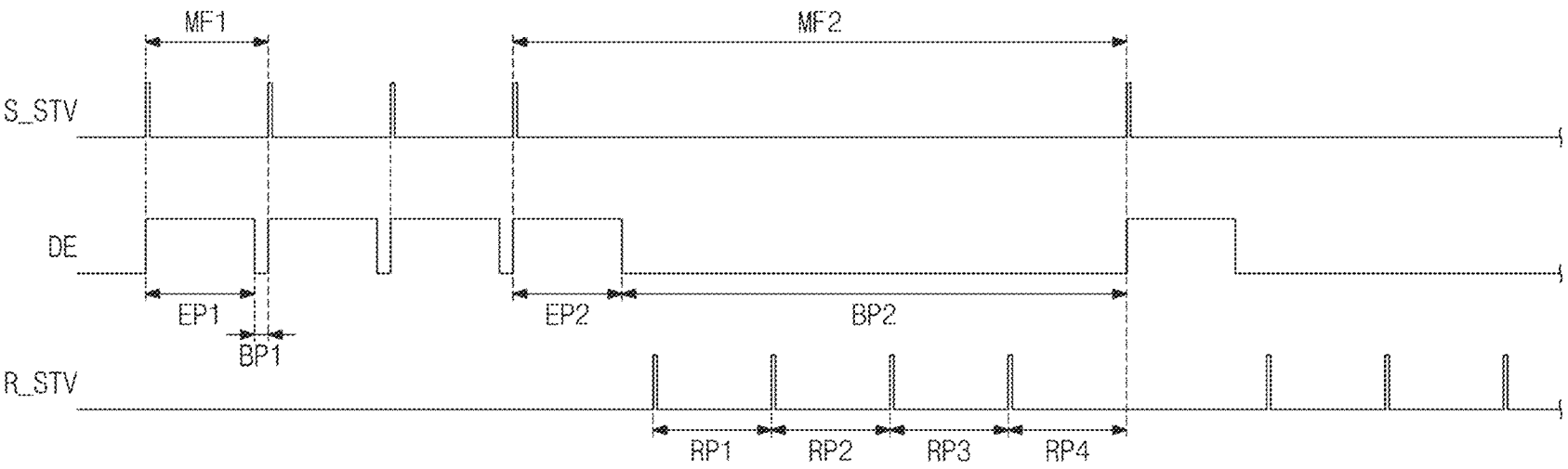
FIG. 5 is a waveform diagram showing first and second start signals shown in FIG. 4.

FIG. 4 is a block diagram showing the first and second scan drivers shown in FIG. 1, and FIG. 5 is a waveform diagram showing first and second start signals shown in FIG. 4.

Referring to FIGS. 1, 4, and 5, an operating frequency of the display panel DP may be defined as a panel frequency. The panel driver may drive the display panel DP at a first panel frequency in a first driving mode and may drive the display panel DP at a second panel frequency in a second driving mode. The second panel frequency may be lower than the first panel frequency. In one embodiment, for example, the second panel frequency may have a frequency of about 15 hertz (Hz), about 30 Hz, or about 48 Hz, and the first panel frequency may have a frequency of about 60 Hz, about 120 Hz, or about 240 Hz.

The first scan driver SD1 may be operated at a first frequency in the first driving mode and may be operated at a second frequency in the second driving mode. In one embodiment, for example, the first frequency may be the same as the first panel frequency, and the second frequency may be the same as the second panel frequency. The second scan driver SD2 may be inactivated in the first driving mode and may be activated in the second driving mode.

In the first driving mode, the display panel DP may display the image during a plurality of first mode frames MF1. In the second driving mode, the display panel DP may display the image during a plurality of second mode frames MF2. Each of the second mode frames MF2 may have a duration greater than a duration of each of the first mode frames MF1.

Each of the first mode frames MF1 may include a first enable period EP1 and a first blank period BP1. The first enable period EP1 may be defined as a period in which the first scan driver SD1 is activated, and the first blank period BP1 may be defined as a period in which the first scan driver SD1 is inactivated. Each of the second mode frames MF2 may include a second enable period EP2 and a second blank period BP2. The second enable period EP2 may be defined as a period in which the first scan driver SD1 is activated, and the second blank period BP2 may be defined as a period in which the first scan driver SD1 is inactivated.

In one embodiment, for example, the first enable period EP1 may have a duration that is the same as a duration of the second enable period EP2. In such an embodiment, the second blank period BP2 may have a duration greater than a duration of the first blank period BP1. In one embodiment, for example, where the first panel frequency is about 240 Hz and the second panel frequency is about 48 Hz, the second blank period BP2 may have the duration approximately four times greater than the duration of the second enable period EP2.

The second scan driver SD2 may be inactivated in each of the first mode frames MF1. When the display panel DP enters the second driving mode, the second scan driver SD2 may be activated in each of the second mode frames MF2. In such an embodiment, the second scan driver SD2 may be activated in the second blank period BP2. The second blank period BP2 may include one or more reset periods RP1 to RP4. In an embodiment, where the first panel frequency is about 240 Hz and the second panel frequency is about 48 Hz, the second blank period BP2 may include four reset periods RP1 to RP4. In an embodiment, where the first panel frequency is about 240 Hz and the second panel frequency is about 30 Hz, the second blank period BP2 may include seven reset periods. In such an embodiment, the number of the reset periods included in the second blank period BP2 should not be particularly limited and may be changed depending on the first and second panel frequencies.

Referring to FIG. 4, the first scan driver SD1 may include a plurality of driving stages ST1 to STn. Each of the driving stages ST1 to STn may receive the first scan control signal SCS1 from the driving controller 100 shown in FIG. 1. The first scan control signal SCS1 may include a first start signal S_STV and first to sixth clock signals S_CK1 to S_CK6. However, the number of the clock signals included in the first scan control signal SCS1 should not be limited thereto or thereby.

Figure 7:
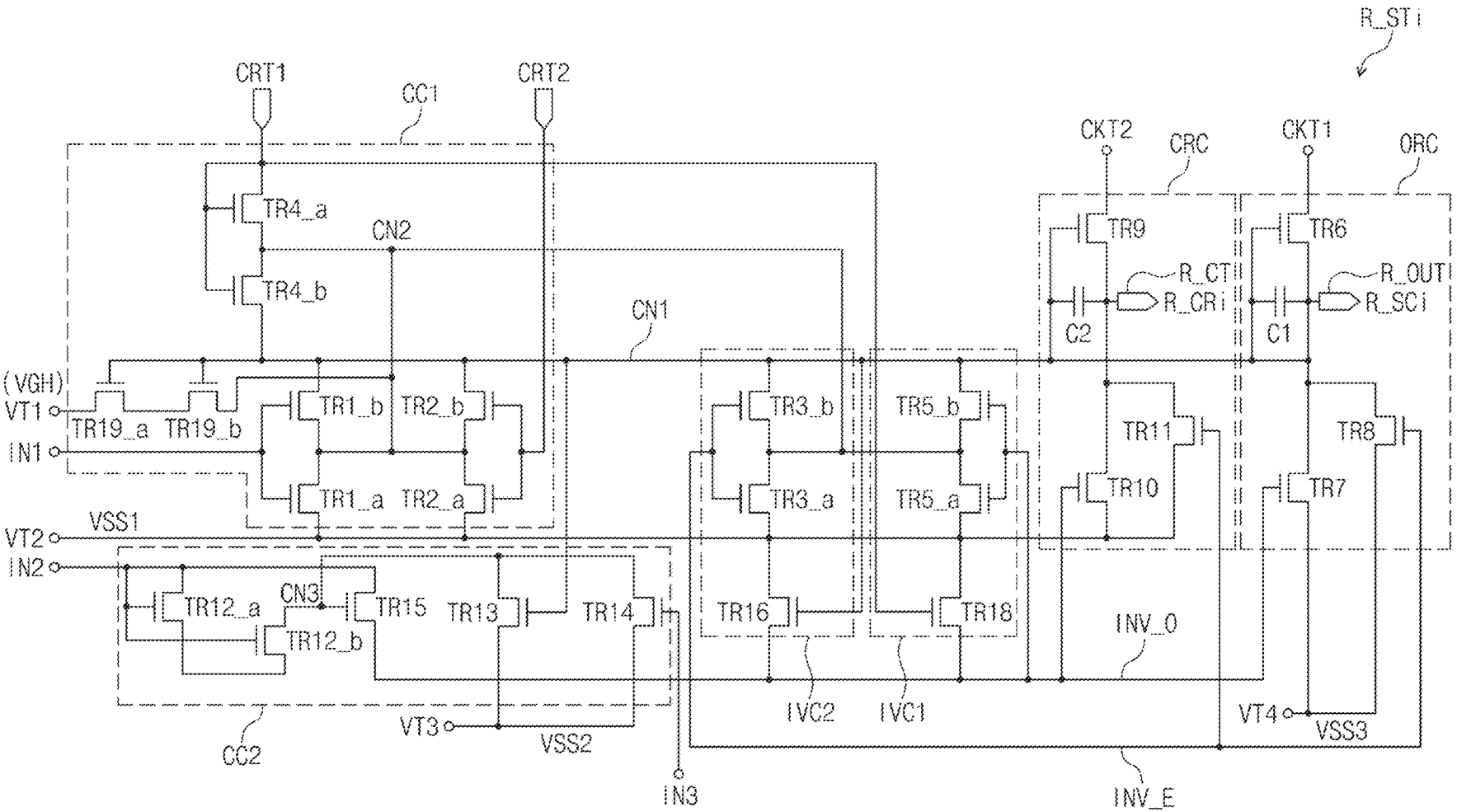
FIG. 7 is a circuit diagram showing a reset stage according to an embodiment of the disclosure.

Each of the driving stages ST1 to STn may further receive at least one voltage, for example, a first voltage VGH (refer to FIG. 7), a second voltage VSS1 (refer to FIG. 7), a third voltage VSS2 (refer to FIG. 7), and a fourth voltage VSS3 (refer to FIG. 7). The first voltage VGH may be higher than the second to fourth voltages VSS1 to VSS3. The first, second, third, and fourth voltages VGH, VSS1, VSS2, and VSS3 may be provided from the voltage generator 300 shown in FIG. 1.

According to an embodiment, each of the driving stages ST1 to STn may output a corresponding compensation scan signal. For the convenience of illustration, FIG. 4 shows only the compensation scan signals SC1 to SCn output from the driving stages ST1 to STn, however, each of the driving stages ST1 to STn may further output a corresponding initialization scan signal. In each of the driving stages ST1 to STn, an output terminal from which the compensation scan signal is output and an output terminal from which the initialization scan signal is output may be distinguished from each other.

The driving stages ST1 to STn may be connected to each other one after another (e.g., in a cascade manner). Each of the driving stages ST1 to STn may apply a carry signal to a next stage adjacent thereto and may receive a carry signal from a previous stage adjacent thereto.

The number of the driving stages ST1 to STn included in the first scan driver SD1 may correspond to the number of the compensation scan lines SCL1 to SCLn (refer to FIG. 1). Alternatively, the first scan driver SD1 may further include first dummy stages activated prior to a first driving stage ST1 among the driving stages ST1 to STn or second dummy stages activated later than a last driving stage STn among the driving stages ST1 to STn.

The second scan driver SD2 may include a plurality of reset stages R_ST1 to R_STk. Each of the reset stages R_ST1 to R_STk may receive the second scan control signal SCS2 from the driving controller 100 shown in FIG. 1. The second scan control signal SCS2 may include a second start signal R_STV, a first reset clock signal R_CK1, and a second reset clock signal R_CK2. However, the number of the reset clock signals included in the second scan control signal SCS2 should not be limited thereto or thereby.

Each of the reset stages R_ST1 to R_STk may further receive at least one voltage, for example, the first voltage VGH, the second voltage VSS1, the third voltage VSS2, and the fourth voltage VSS3.

The number of the reset stages R_ST1 to R_STk included in the second scan driver SD2 may be smaller than the number of the driving stages ST1 to STn included in the first scan driver SD1. In an embodiment where n driving stages ST1 to STn are included in the first scan driver SD1 and k reset stages R_ST1 to R_STk are included in the second scan driver SD2, "k" may be an integer smaller than "n".

The number of the reset stages R_ST1 to R_STk included in the second scan driver SD2 may be smaller than the number of the reset scan lines R_SL1 to R_SLn (refer to FIG. 1). In an embodiment where the display panel DP includes n reset scan lines R_SL1 to R_SLn, the second scan driver SD2 may include k, which is smaller than "n", reset stages R_ST1 to R_STk. FIG. 4 shows one embodiment having a structure in which "n" is eight times greater than "k", however, the disclosure should not be limited thereto or thereby. In such an embodiment, "n" may be an integer multiple of "k", for example 2, 4 or 16 times.

Each of the reset stages R_ST1 to R_STk may be electrically connected to corresponding p reset scan lines. Here, "p" may be equal to or greater than 1. FIG. 4 shows one embodiment where a structure in which "p" is 8, however, the disclosure should not be limited thereto or thereby. Alternatively, "p" may be 2, 4, or 16. in an embodiment, a first reset stage R_ST1 may be electrically connected to the first to eighth reset scan lines R_SL1 to R_SLB, and a second reset stage R_ST2 may be electrically connected to ninth to sixteenth reset scan lines R_SL9 to R_SL16. Accordingly, a first reset scan signal R_SC1 output from the first reset stage R_ST1 may be commonly applied to the first to eighth reset scan lines R_SL1 to R_SLB, and a second reset scan signal R_SC2 output from the second reset stage R_ST2 may be commonly applied to the ninth to sixteenth reset scan lines R_SL9 to R_SL16.

As shown in FIGS. 4 and 5, the second start signal R_STV applied to the second scan driver SD2 may be activated during the second blank period BP2 in the second driving mode. Accordingly, the active period of the second start signal R_STV may not overlap the active period of the first start signal S_STV, and the active period of the second start signal R_STV may not overlap the second enable period EP2.

In the second blank period BP2, the second start signal R_STV may be generated at the first frequency that is the same as the first frequency of the first start signal S_STV in the first driving mode. That is, although the first start signal S_STV is generated at the second frequency lower than the first frequency in the second driving mode, the anode, i.e., the second node N2 (refer to FIG. 2), of the light emitting element ED (refer to FIG. 2) of each pixel PXij (refer to FIG. 2) may be periodically reset in second driving mode when the second start signal R_STV is generated at the first frequency in the second blank period BP2. Accordingly, the anode of the light emitting element ED (refer to FIG. 2) may be periodically reset at the first frequency in the second blank period BP2 as in the first driving mode, and as a result, a phenomenon in which the luminance difference is recognized in the low grayscale when the first driving mode is switched to the second driving mode may be effectively prevented.

Figure 6:
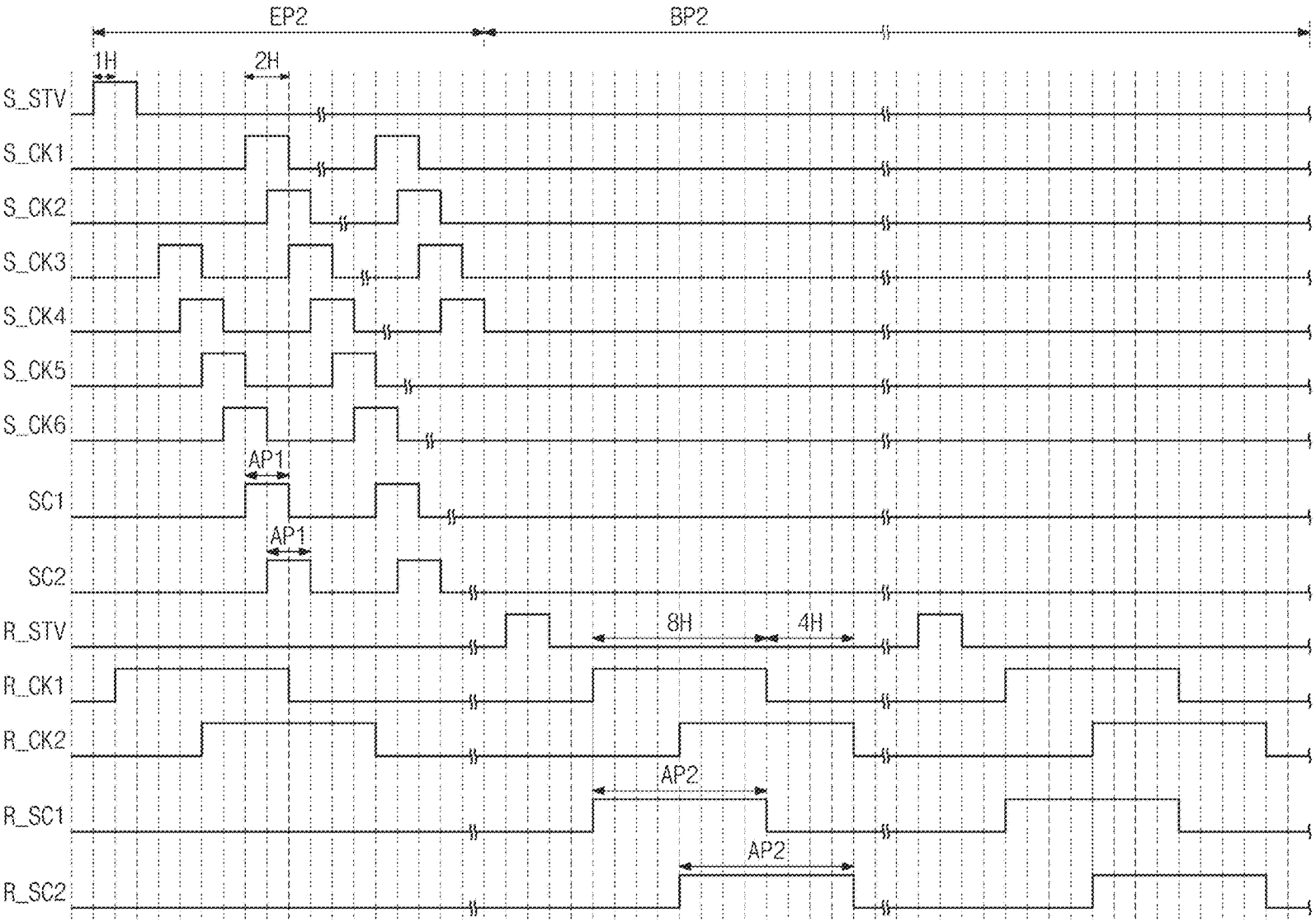
FIG. 6 is a signal timing diagram showing an operation of the first and second scan drivers shown in FIG. 4.

FIG. 6 is a signal timing diagram showing an operation of the first and second scan drivers shown in FIG. 4.

Referring to FIGS. 4 to 6, the first scan driver SD1 may output the compensation scan signals SC1 to SCn for the second enable period EP2 in the second driving mode. The active period AP1 of each of the compensation scan signals SC1 to SCn may be included in the second enable period EP2. In one embodiment, for example, the active period AP1 of each of the compensation scan signals SC1 to SCn may have a duration of 2H.

The duration of the active period AP1 of each of the compensation scan signals SC1 to SCn may be determined by a duration of the high period of the corresponding clock. In one embodiment, for example, each of the first to sixth clock signals S_CK1 to S_CK6 may have the high period corresponding to the 2H duration. Accordingly, a first compensation scan signal SC1 may have the active period AP1 corresponding to a high period of a corresponding first clock signal S_CK1, and the second compensation scan signal SC2 may have the active period AP1 corresponding to a high period of a corresponding second clock signal S_CK2. The first to sixth clock signals S_CK1 to S_CK6 may have a phase sequentially delayed by a time of 1H. Therefore, two compensation scan signals output from two driving stages adjacent to each other may overlap each other for 1H. In such an embodiment, the active period AP1 of the first compensation scan signal SC1 may overlap the active period AP1 of the second compensation scan signal SC2 by 1H period.

In the second driving mode, the second scan driver SD2 may output the reset scan signals R_SC1 to R_SCk for the second blank period BP2. The active period AP2 of each of the reset scan signals R_SC1 to R_SCk may be defined in the second blank period BP2. In one embodiment, for example, the active period AP2 of each of the reset scan signals R_SC1 to R_SCk may have a duration of about 8H.

The duration of the active period AP2 of the reset scan signals R_SC1 to R_SCk may be determined by a duration of a high period of a corresponding clock. In one embodiment, for example, each of the first and second reset clock signals R_CK1 and R_CK2 may have the high period corresponding to the duration of about 8H. Accordingly, the first reset scan signal R_SC1 may have the active period AP2 corresponding to the high period of the corresponding first reset clock signal R_CK1, and the second reset scan signal R_SC2 may have the active period AP2 corresponding to the high period of the corresponding second reset clock signal R_CK2. The first and second reset clock signals R_CK1 and R_CK2 may have a phase sequentially delayed by a time of 4H. Accordingly, two reset scan signals output from two reset stages adjacent to each other may overlap each other for about 4H. In such an embodiment, the active period AP2 of the first reset scan signal R_SC1 may overlap the active period AP2 of the second reset scan signal R_SC2 by a period of 4H.

The duration of the active period AP2 of each of the reset scan signals R_SC1 to R_SCk may be greater than the duration of the active period AP1 of each of the compensation scan signals SC1 to SCn and the duration of the active period of each of the initialization scan signals SI1 to SIn. The duration of the active period AP2 of the reset scan signals R_SC1 to R_SCk may be changed depending on the number of the reset scan lines commonly connected to each of the reset stages R_ST1 to R_STk. In one embodiment, for example, where four reset scan lines are commonly connected to each of the reset stages R_ST1 to R_STk, the active period AP2 of each of the reset scan signals R_SC1 to R_SCk may have the duration corresponding to about 4H. In an alternative embodiment, where sixteen reset scan lines are commonly connected to each of the reset stages R_ST1 to R_STk, the active period AP2 of each of the reset scan signals R_SC1 to R_SCk may have the duration corresponding to about 16H.

FIG. 7 is a circuit diagram showing a reset stage R_STi according to an embodiment of the disclosure.

FIG. 7 shows a circuit diagram of an embodiment of one reset stage R_STi among the reset stages R_ST1 to R_STk shown in FIG. 4. Since the reset stages R_ST1 to R_STk have substantially the same circuit configuration as each other, the one reset stage R_STi will be described in detail with reference to FIG. 7, and any repetitive detailed descriptions of the other reset stages will be omitted.

Referring to FIGS. 4 and 7, an embodiment of the reset stage R_STi may include a reset output part ORC, a reset carry part CRC, a first control part CC1, a second control part CC2, a first reset inverter IVC1, and a second reset inverter IVC2.

The reset output part ORC may be connected to a first clock terminal CKT1, to which the first reset clock signal R_CK1 is applied, and an output terminal R_OUT, from which the reset scan signal R_SCi is output. The reset output part ORC may include first, second, and third output transistors TR6, TR7, and TR8 and a first capacitor C1. The first output transistor TR6 may be connected between the first clock terminal CKT1 and a first control node CN1. In such an embodiment, the first output transistor TR6 may output the first reset clock signal R_CK1 to the output terminal R_OUT in response to a first control signal applied to the first control node CN1. In such an embodiment, the first output transistor TR6 may output the high period of the first reset clock signal R_CK1 as the first reset scan signal R_SCi in response to the first control signal. The first capacitor C1 may be connected between the first control node CN1 and the output terminal R_OUT. The second and third output transistors TR7 and TR8 may be connected between the output terminal R_OUT and a fourth voltage terminal VT4, to which the fourth voltage VSS3 is applied. In such an embodiment, the second output transistor TR7 may discharge an electric potential of the output terminal R_OUT to the fourth voltage VSS3 in response to a first inverter signal applied to a first inverter node INV_O, and the third output transistor TR8 may discharge the electric potential of the output terminal R_OUT to the fourth voltage VSS3 in response to a second inverter signal applied to a second inverter node INV_E. The first inverter signal and the second inverter signal may be activated alternately with each other. In one embodiment, for example, in a case where the reset stage R_STi is an odd-numbered stage, the first inverter signal may be activated, and in a case where the reset stage R_STi is an even-numbered stage, the second inverter signal may be activated.

The reset carry part CRC may be connected to a second clock terminal CKT2, to which the second reset clock signal R_CK2 is applied, and a carry output terminal R_CT, from which a reset carry signal R_CRi is output. The reset carry part CRC may include first, second, and third carry transistors TR9, TR10, and TR11 and a second capacitor C2. The first carry transistor TR9 may be connected between the second clock terminal CKT2 and the first control node CN1. In such an embodiment, the first carry transistor TR9 may output the second reset clock signal R_CK2 to the carry output terminal R_CT in response to the first control signal applied to the first control node CN1. In such an embodiment, the first carry transistor TR9 may output the high period of the second reset clock signal R_CK2 as the reset carry signal R_CRi in response to the first control signal. The second capacitor C2 may be connected between the first control node CN1 and the carry output terminal R_CT.

The second and third carry transistors TR10 and TR11 may be connected between the carry output terminal RCT and a second voltage terminal VT2, to which the second voltage VSS1 is applied. In such an embodiment, the second carry transistor TR10 may discharge an electric potential of the carry output terminal R_CT to the second voltage VSS1 in response to the first inverter signal applied to the first inverter node INV_O, and the third carry transistor TR11 may discharge the electric potential of the carry output terminal R_CT to the second voltage VSS1 in response to the second inverter signal applied to the second inverter node INV_E.

The first control part CC1 may be connected to first and second carry input terminals CRT1 and CRT2 and first and second voltage terminals VT1 and VT2 to control a state of the first control signal output to the first control node CN1. The first control part CC1 may include first, second, third, and fourth control transistors. The first control transistor may be connected between the first carry input terminal CRT1 and the first control node CN1. In such an embodiment, the first control transistor may include first and second sub-control transistors TR4_*a* and TR4_*b* connected to each other in series between the first carry input terminal CRT1 and the first control node CN1. The first and second sub-control transistors TR4_a and TR4_b may activate the first control node CN1 in response to a previous reset carry signal applied to the first carry input terminal CRT1. The previous reset carry signal may be a reset carry signal output from a previous reset stage that is activated prior to the reset stage R_STi. In one embodiment, for example, the previous reset stage may be an (i−3)-th stage.

The second control transistor may be connected between the second voltage terminal VT2 and the first control node CN1. In such an embodiment, the second control transistor may include third and fourth sub-control transistors TR2_a and TR2_b connected to each other in series between the second voltage terminal VT2 and the first control node CN1. The third and fourth sub-control transistors TR2_a and TR2_b may inactivate the first control node CN1 to the second voltage VSS1 in response to a next reset carry signal applied to the second carry input terminal CRT2. The next reset carry signal may be a reset carry signal output from a next reset stage that is activated later than the reset stage R_STi. In one embodiment, for example, the next reset stage may be an (i+4)-th stage.

The third control transistor may be connected between the second voltage terminal VT2 and the first control node CN1. In such an embodiment, the third control transistor may include fifth and sixth sub-control transistors TR1_a and TR1_b connected to each other in series between the second voltage terminal VT2 and the first control node CN1. The fifth and sixth sub-control transistors TR1_a and TR1_b may reset the first control node CN1 to the second voltage VSS1 in response to the second start signal R_STV applied to a first input terminal IN1.

A node, to which the first and second sub-control transistors TR4_a and TR4_b are connected, a node, to which the third and fourth sub-control transistors TR2_a and TR2_b are connected, and a node, to which the fifth and sixth sub-control transistors TR1_a and TR1_b are connected, may be connected to each other, and such a node may be referred to as a second control node CN2.

The fourth control transistor may be connected between the first voltage terminal VT1 and the second control node CN2. In such an embodiment, the fourth control transistor may include seventh and eighth sub-control transistors TR19_a and TR19_b connected to each other in series between the first voltage terminal VT1 and the second control node CN2. The first voltage VGH may be applied to the first voltage terminal VT1. The seventh and eighth sub-control transistors TR19_a and TR19_b may apply the first voltage VGH to the second control node CN2 in response to the first control signal of the first control node CN1.

The second control part CC2 may be connected to a second input terminal IN2, second and third voltage terminals VT2 and VT3, and the first control node CN1 to control a state of the first or second inverter signal applied to the first or second inverter node INV_O or INV_E. In a case where the reset stage R_STi is an odd-numbered stage, the second control part CC2 may be connected to the first inverter node INV_O, and in a case where the reset stage R_STi is an even-numbered stage, the second control part CC2 may be connected to the second inverter node INV_E. FIG. 7 shows an embodiment having a structure in which the second control part CC2 is connected to the first inverter node INV_O, for example. The first or second inverter control signal may be applied to the second input terminal IN2. In a case where the reset stage R_STi is the odd-numbered stage, the first inverter control signal is applied to the second input terminal IN2, and in a case where the reset stage R_STi is the even-numbered stage, the first inverter control signal may be applied to the second input terminal IN2.

The second control part CC2 may include fifth, sixth, seventh, and eighth control transistors. The fifth control transistor may be connected between the second input terminal IN2 and a third control node CN3. In such an embodiment, the fifth control transistor may include ninth and tenth sub-control transistors TR12_a and TR12_b connected to each other in series between the second input terminal IN2 and the third control node CN3. The ninth and tenth sub-control transistors TR12_a and TR12_b may activate the third control node CN3 in response to the first inverter control signal applied to the second input terminal IN2.

The sixth control transistor TR15 may be connected between the second input terminal IN2 and the first inverter node INV_O and may be operated according to the electric potential of the third control node CN3. When the third control node CN3 is activated, the sixth control transistor TR15 may be turned on and may apply the first inverter control signal to the first inverter node INV_O.

The seventh control transistor TR13 may be connected between the third control node CN3 and the third voltage terminal VT3 and may be operated according to the electric potential of the first control node CN1. When the first control node CN1 is activated, the seventh control transistor TR13 may be turned on, and the electric potential of the third control node CN3 may be discharged to the third voltage VSS2.

The eighth control transistor TR14 may be connected between the third control node CN3 and the third voltage terminal VT3 and may be operated in response to a second control signal applied thereto via a third input terminal IN3. The second control signal may be the first control signal provided from a first control node of the reset stage immediately after the reset stage R_STi. In one embodiment, for example, the reset stage immediately after the reset stage R_STi may be an (i+1)-th stage. When the second control signal is activated, the eighth control transistor TR14 may be turned on, and the electric potential of the third control node CN3 may be discharged to the third voltage VSS2.

The first reset inverter IVC1 may include first and second inverter transistors, and the second reset inverter IVC2 may include third and fourth inverter transistors.

The first inverter transistor may be connected between the first control node CN1 and the second voltage terminal VT2 and may be operated in response to the first inverter signal. The first inverter transistor may include first and second sub-inverter transistors TR5_a and TR5_b connected to each other in series between the first control node CN1 and the second voltage terminal VT2. When the first and second sub-inverter transistors TR5_a and TR5_b are turned on in response to the first inverter signal, the electric potential of the first control node CN1 may be discharged to the second voltage VSS1. The second inverter transistor TR18 may be connected between the second voltage terminal VT2 and the first inverter node INV_O and may be operated in response to the previous reset carry signal applied to the first carry input terminal CRT1. When the second inverter transistor TR18 is turned on in response to the previous reset carry signal, the electric potential of the first inverter node INV_O may be discharged to the second voltage VSS1.

The third inverter transistor may be connected between the first control node CN1 and the second voltage terminal VT2 and may be operated in response to the second inverter signal. The third inverter transistor may include third and fourth sub-inverter transistors TR3_a and TR3_b connected to each other in series between the first control node CN1 and the second voltage terminal VT2. When the third and fourth sub-inverter transistors TR3_a and TR3_b are turned on in response to the second inverter signal, the electric potential of the first control node CN1 may be discharged to the second voltage VSS1. The fourth inverter transistor TR16 may be connected between the second voltage terminal VT2 and the first inverter node INV_O and may be operated in response to the first control signal applied to the first control node CN1. When the fourth inverter transistor TR16 is turned on in response to the first control signal, the electric potential of the first inverter node INV_O may be discharged to the second voltage VSS1.

In the second scan driver, the first reset inverter IVC1 and the second reset inverter IVC2 may be operated alternately with each other. In one embodiment, for example, when the first reset inverter IVC1 is activated in the odd-numbered reset stage in response to the first inverter control signal, the second reset inverter IVC2 may be inactivated. In such an embodiment, when the second reset inverter IVC2 is activated in the even-numbered reset stage in response to the second inverter control signal, the first reset inverter IVC1 may be inactivated.

FIG. 7 shows an embodiment having a structure in which the reset stage includes twenty five transistors and two capacitors C1 and C2, however, the circuit configuration of the reset stage R_STi should not be limited thereto or thereby. In embodiments, the connection relation and the number of the transistors and capacitors included in the reset stage R_STi may be changed in various ways.

Figure 8:
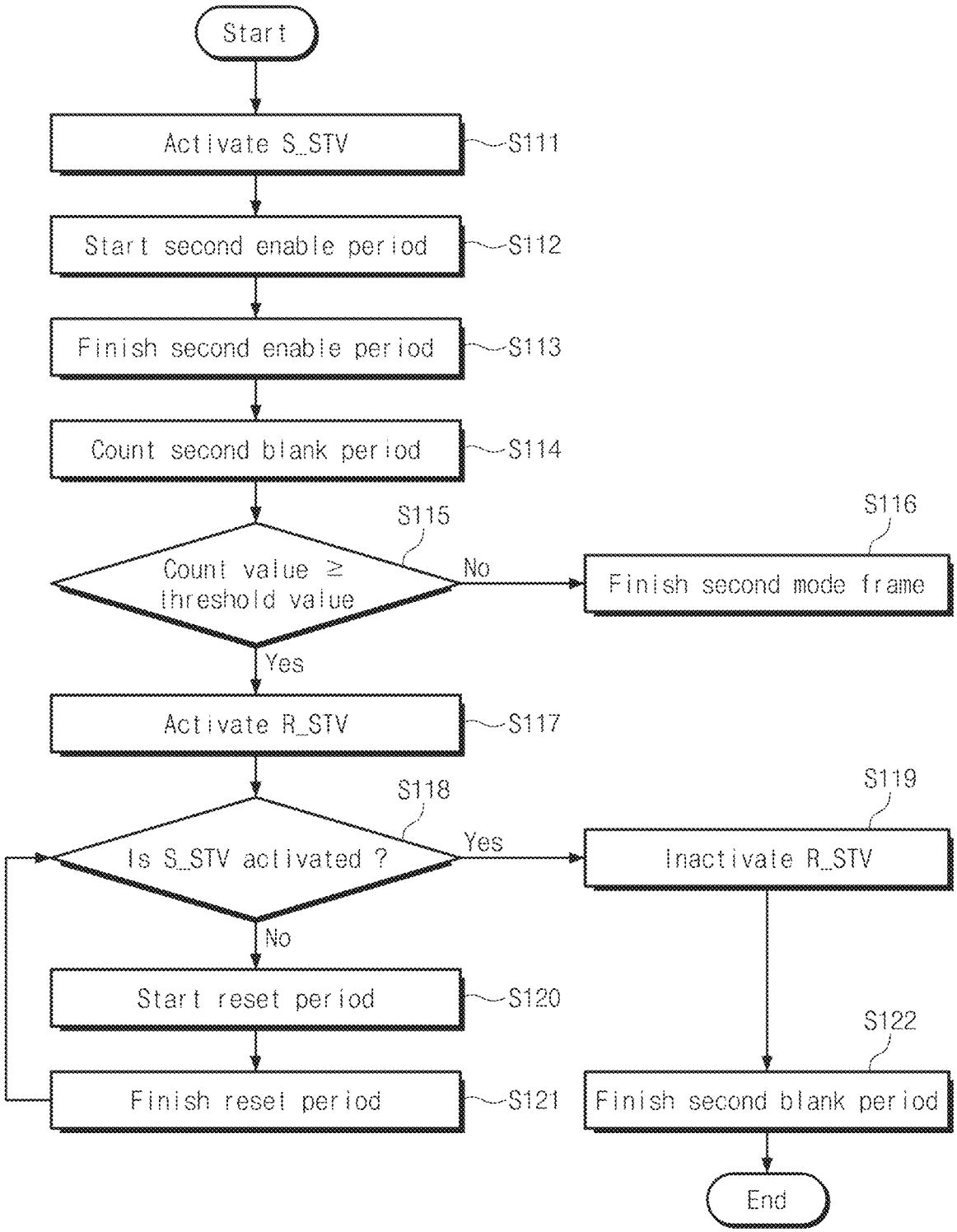
FIG. 8 is a flowchart showing a method of driving a display device according to an embodiment of the disclosure.

FIG. 8 is a flowchart showing a method of driving the display device according to an embodiment of the disclosure.

Referring to FIGS. 1, 4, 5, and 8, according to an embodiment of a method of driving the display device DD, the display device DD may display the image for the first mode frames MF1 in the first driving mode and may display the image for the second mode frames MF2 in the second driving mode.

In response to the first start signal S_STV, the first scan driver SD1 may be operated at the first frequency in the first driving mode and may be operated at the second frequency in the second driving mode. In response to the second start signal R_STV, the second scan driver SD2 may be inactivated in the first driving mode and may be activated in the second driving mode.

Hereinafter, the operation of the display device in the second driving mode will be described in detail with reference to FIG. 8.

In an embodiment, when the second driving mode starts, the first start signal S_STV may be activated (S111). When the first start signal S_STV is activated, the second enable period EP2 starts in the second mode frame MF2 (S112). The first scan driver SD1 is activated during the second enable period EP2, and the compensation scan signals SC1 to SCn and the initialization scan signals SI1 to SIn may be output from the first scan driver SD1.

Then, when the second enable period EP2 is finished, the first scan driver SD1 is inactivated (S113).

When the second enable period EP2 is finished, the second blank period BP2 starts, and the display device DD starts counting from a start point of the second blank period BP2 (S114). When the first start signal S_STV or the compensation scan signals SC1 to SCn is generated in the counting operation, the counting operation may be finished immediately.

After that, a count value is compared with a predetermined threshold value (S115). According to the result of the comparison, when the threshold value is smaller than the count value, the second mode frame is finished (S116), and when the threshold value is equal to or greater than the count value, the second start signal R_STV is activated (S117).

Whether the first start signal S_STV is activated is determined again while the second start signal R_STV is being activated (S118). According to the result of the determination, when the first start signal S_STV is in an activated state, the second start signal R_STV is inactivated (S119), and when the first start signal S_STV is in an inactivated state, the reset periods RP1 to RP4 start (S120).

During the reset periods RP1 to RP4, the second scan driver SD2 is activated, and the reset scan signals R_SC1 to R_SCn are output from the second scan driver SD2. Then, when the first scan driver SD1 is inactivated and the reset period is finished (S121), the operation returns to the operation (S118) again to determine whether the first start signal S_STV is activated. When the first start signal S_STV is in the inactivated state, operations S119 and S120 are performed again.

In such an embodiment, when the first start signal S_STV is in the activated state, the second start signal R_STV is inactivated, and the second blank period BP2 is finished (S122).

As the second scan driver SD2 is activated in the second blank period BP2, the anode, i.e., the second node N2 (refer to FIG. 2), of the light emitting element ED (refer to FIG. 2) of each pixel PXij (refer to FIG. 2) may be periodically reset in second driving mode. Accordingly, the anode of the light emitting element ED (refer to FIG. 2) may be periodically reset at the first frequency in the second blank period BP2 as in the first driving mode, such that the luminance difference in the low grayscale may be effectively prevented from occurring even though the first driving mode is switched to the second driving mode.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims.

What is claimed is:

1. A display device comprising:

a display panel comprising a pixel; and a panel driver which drives the display panel at a first panel frequency in a first driving mode and drives the display panel at a second panel frequency lower than the first panel frequency in a second driving mode, wherein the pixel comprises:

a light emitting element comprising a cathode and an anode;

a first transistor connected between a first driving voltage line and the anode of the light emitting element;

a second transistor connected between a data line and a first electrode of the first transistor, wherein the second transistor receives a first scan signal;

a third transistor connected between a second electrode of the first transistor and an initialization voltage line, wherein the third transistor receives a second scan signal; and a fourth transistor connected between the second electrode of the first transistor and a reset voltage line, wherein the fourth transistor receives a third scan signal, wherein the third scan signal is inactivated in the first driving mode and is activated in the second driving mode.

2. The display device of claim 1, wherein the display panel displays an image in a unit of a first mode frame in the first driving mode and displays the image in a unit of a second mode frame in the second driving mode, the first mode frame comprises a first enable period and a first blank period, the second mode frame comprises a second enable period and a second blank period, and the third scan signal is activated in the second blank period.

3. The display device of claim 2, wherein the first and second scan signals are activated during the first enable period in the first driving mode, and the first and second scan signals are activated during the second enable period in the second driving mode.

4. The display device of claim 1, wherein the cathode of the light emitting element is connected to a second driving voltage line, and the reset voltage line is electrically connected to the second driving voltage line.

5. The display device of claim 1, wherein the reset voltage line is electrically connected to the initialization voltage line.

6. The display device of claim 1, wherein the reset voltage line receives a reset voltage.

7. The display device of claim 1, wherein the pixel further comprises:

a first capacitor disposed between the second electrode of the first transistor and a third electrode of the first transistor; and a second capacitor disposed between the anode and the cathode of the light emitting element.

8. The display device of claim 1, wherein the panel driver comprises:

a first scan driver which outputs the first and second scan signals; and a second scan driver which outputs the third scan signal.

9. The display device of claim 8, wherein the display panel further comprises:

a plurality of first scan lines connected to the first scan driver;

a plurality of second scan lines connected to the first scan driver and spaced apart from the first scan lines; and a plurality of third scan lines connected to the second scan driver and spaced apart from the first and second scan lines.

10. The display device of claim 9, wherein at least p scan lines among the third scan lines are electrically connected to each other, wherein p is an integer greater than 1.

11. The display device of claim 10, wherein a duration of an active period of the third scan signal is greater than a duration of an active period of each of the first and second scan signals.

12. The display device of claim 8, wherein the first scan driver receives a first start signal, the second scan driver receives a second start signal, the first start signal is activated in the first and second driving modes, and the second start signal is activated in the second driving mode.

13. The display device of claim 12, wherein the display panel displays an image in a unit of a first mode frame in the first driving mode and displays the image in a unit of a second mode frame in the second driving mode, the first mode frame comprises a first enable period and a first blank period, the second mode frame comprises a second enable period and a second blank period, and the second start signal is activated in the second blank period.

14. A display device comprising:

a display panel comprising a pixel; and a panel driver which drives the display panel at a first panel frequency in a first driving mode and drives the display panel at a second panel frequency lower than the first panel frequency in a second driving mode, wherein the panel driver comprises:

a first scan driver which outputs first and second scan signals to the pixel; and a second scan driver which outputs a third scan signal to the pixel, wherein the display panel displays an image in a unit of a first mode frame in the first driving mode and displays the image in a unit of a second mode frame in the second driving mode, the first mode frame comprises a first enable period and a first blank period, the second mode frame comprises a second enable period and a second blank period, the first scan driver is activated in the first and second enable periods, and the second scan driver is activated in the second blank period.

15. The display device of claim 14, wherein the display panel further comprises:

a plurality of first scan lines connected to the first scan driver;

a plurality of second scan lines connected to the first scan driver and spaced apart from the first scan lines; and a plurality of third scan lines connected to the second scan driver and spaced apart from the first and second scan lines.

16. The display device of claim 15, wherein at least p scan lines among the third scan lines are electrically connected to each other, wherein p is an integer greater than 1.

17. The display device of claim 16, wherein a duration of an active period of the third scan signal is greater than a duration of an active period of each of the first and second scan signals.

18. The display device of claim 14, wherein the first scan driver receives a first start signal, the second scan driver receives a second start signal, the first start signal is activated in the first and second driving modes, and the second start signal is activated in the second driving mode.

19. The display device of claim 18, wherein the second start signal is activated in the second blank period.

20. The display device of claim 14, wherein the pixel comprises:

a light emitting element comprising a cathode and an anode;

a first transistor connected between a first driving voltage line and the anode of the light emitting element;

a second transistor connected between a data line and a first electrode of the first transistor, wherein the second transistor receives the first scan signal;

a third transistor connected between a second electrode of the first transistor and an initialization voltage line, wherein the third transistor receives the second scan signal; and a fourth transistor connected between the second electrode of the first transistor and a reset voltage line, wherein the fourth transistor receives the third scan signal.

* * * * *